US005092389A

United States Patent [19]

Tedeschi

[11] Patent Number: 5,092,389

[45] Date of Patent: Mar. 3, 1992

[54] DEVICE FOR CONTROLLING THE OPERATION OF A ROLL-UP CLOTH CURTAIN

[75] Inventor: Giovanni Tedeschi, Funo di Argelato, Italy

[73] Assignee: Sunproject S.R.L., Bologna, Italy

[21] Appl. No.: 643,766

[22] Filed: Jan. 22, 1991

[30] Foreign Application Priority Data

Jan. 26, 1990 [IT] Italy ..... 4713 /90[U]

[51] Int. Cl.[5] ..... A47H 1/00

[52] U.S. Cl. ..... 160/321; 160/323.1

[58] Field of Search ..... 160/321, 319, 323.1, 160/250, 263, 324, 325, 326, 23.1, 320

[56] References Cited

U.S. PATENT DOCUMENTS

| | | | |
|---|---|---|---|
| 3,854,517 | 12/1974 | Nakamura | 160/321 X |
| 4,139,044 | 2/1979 | Brolin | 160/321 |
| 4,448,233 | 5/1984 | Rombouts | 160/319 |
| 4,834,164 | 5/1989 | Tuhey | 160/319 |
| 4,884,618 | 12/1989 | Steeves | 160/321 |

FOREIGN PATENT DOCUMENTS

| | | |
|---|---|---|
| 870311 | 5/1987 | Netherlands . |
| 1459053 | 12/1976 | United Kingdom . |
| 2212543 | 7/1989 | United Kingdom . |

*Primary Examiner*—David M. Purol
*Attorney, Agent, or Firm*—Darby & Darby

[57] ABSTRACT

In a device for controlling a roll-up curtain roller for a curtain to be placed in an opening, a pulley is linked to the curtain roller and has a race forming a lock slot for a driving rope, and a plate supports the pulley and is available for fastening the device to an end of a box in which the roller with the curtain thereon is housed. A guide has a center hole through which passes a grooved cylinder of the pulley, and is mounted on the pulley along the race in an intermediate position between the plate and the box. The guide is provided, on opposite sides, with a first and a second pair of slits through the rope can come out of either one or both of the pair of slits so that the device can be operated from either one or both sides of the opening in which the curtain is placed.

6 Claims, 2 Drawing Sheets

DEVICE FOR CONTROLLING THE OPERATION OF A ROLL-UP CLOTH CURTAIN

BACKGROUND OF THE INVENTION

This invention relates to the technical field concerning the operation of roll-up cloth curtains, mosquitonets and the like.

DESCRIPTION OF THE PRIOR ART

It is known that roll-up cloth curtains require a control device by which it is possible to operate the winding of the cloth curtain on a roller which supports the curtain.

A known device of this kind is provided with a pulley which is suited to be fastened to an end of a cloth winding roller and features a lock slot for a driving rope. The pulley is cantilever-supported by a head which is fastened to a corresponding end of a box in which is located the cloth winding roller.

The driving rope comes out of the control device through a special slit, generally made in the side of the box that is inside the room.

This turns out to be disadvantageous, when it is desired to operate the roll-up cloth curtain also from outside the room, e.g. in the case that the roll-up cloth curtain is fitted to windows opening onto terraces, gardens and the like.

Furthermore, since the slit is made in one side of the box, i.e the side that remains inside the room, becomes necessary to determine unilaterally the assembly side of the control device with respect to the winding roller, and this may not be suited to the installation requirements of the roll-up cloth curtain.

SUMMARY OF THE INVENTION

The objects of this invention is to provide a device for operating a roll-up cloth curtain of universal use, particularly allowing the operation from outside and/or from inside the room to the window of which the curtain is fitted.

A further object of this invention is to provide a device for controlling the operation of a roll-up cloth curtain, which is simple, functional, reliable as well as cheap.

The aforesaid objects are accomplished by means of a device for controlling the operation of a roll-up cloth curtain from outside and/or inside the room to the window of which the curtain is fitted, of the type comprising a pulley which is suited to draw into rotation a cloth winding roller and featuring a race forming a lock slot for a driving rope, and a plate which is suited to cantilever-support said pulley and to be fastened to a corresponding end of a box where said cloth winding roller is housed. The device has a means for guiding said rope which is suited to be mounted on said pulley along said race and to be associated with said plate in an intermediate position between the same plate and said box. The guide means is symmetrically provided, on opposite sides, with a first and a second pair of slits through which the rope comes out, respectively turned towards the outside and the inside of the room to the window of which the curtain is fitted.

BRIEF DESCRIPTION OF THE DRAWINGS

The features of this invention will be described further, by way of example, with reference to the accompanying drawings, wherein.

DESCRIPTION OF THE PREFERRED EMBODIMENT

Figure 1:
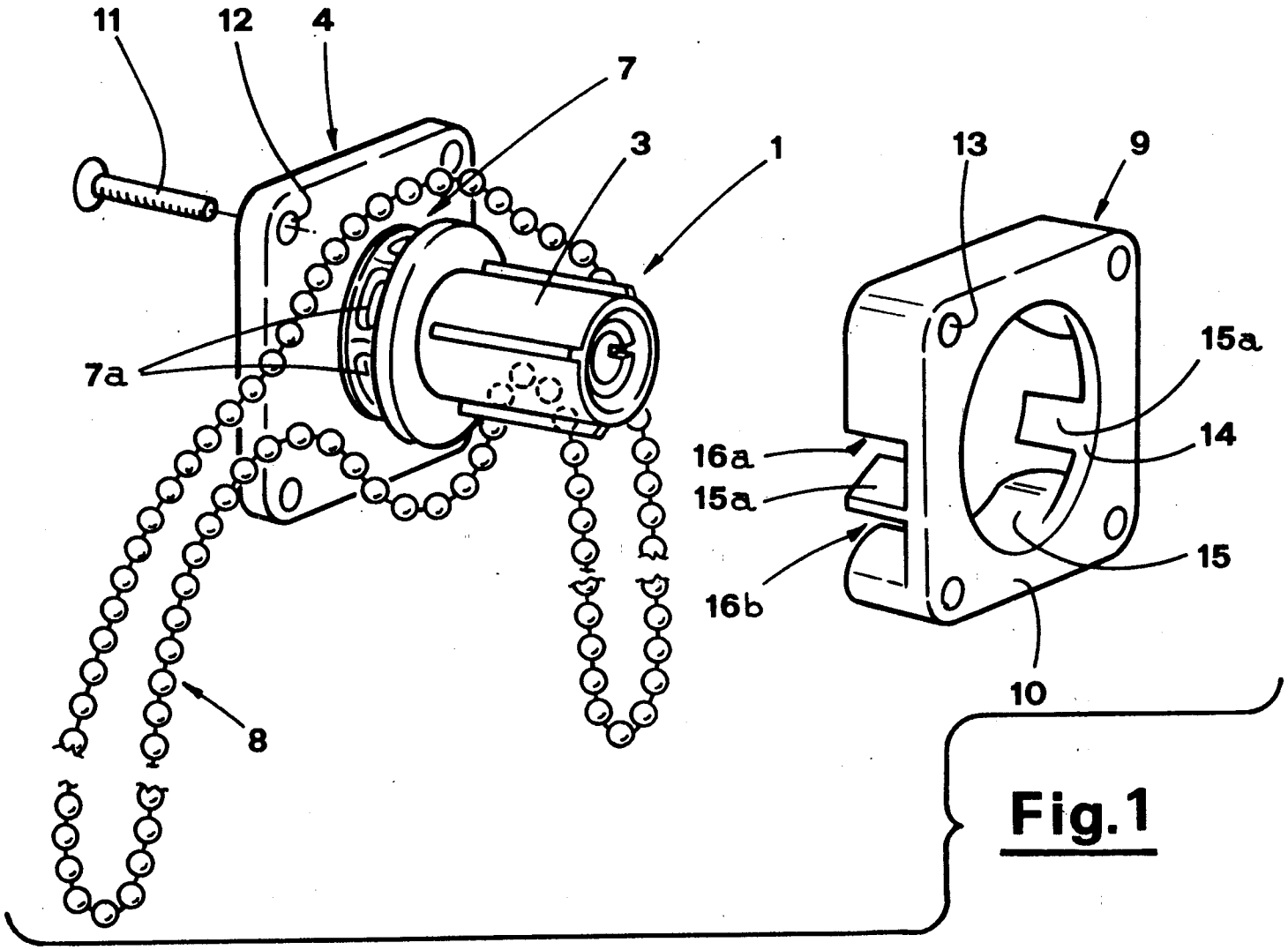
FIG. 1 is an exploded perspective view of the device for operating a roll-up cloth curtain being the object of this invention.

Like reference numerals are employed to designate like parts throughout the various figures of the drawings.

Referring to the above-mentioned figures, the numeral 1 generally designates a pulley for controlling the operation of a roll-up curtain 2 of cloth or other suitable material. The pulley causes in a known way, e.g. by the interposition of friction means (not illustrated) the rotation of a grooved cylinder 3 designed to engage an end of a cloth 2 winding roller, not illustrated in the drawings. The pulley 1 is suited to be cantilever-supported by a plate 4, of square shape; the plate 4 is designed to be fastened to a corresponding end of a box 5, where is located the cloth winding roller. On the sides of the box 5 the cloth curtain slideways 6 extend downwards.

The pulley 1 features, close to the plate 4, a race 7 provided with lock slots **7*a* for a rope 8 driving the device. In the embodiment illustrated, said rope 8** is made up of a series of ball elements assembled along a line closed like a ring i.e., a beaded chain.

According to this invention, the control device comprises a guide means, generally designated by the numeral 9. The guide means 9 includes of a body 10 which is suited to be assembled onto the pulley 1, close to the race 7; the body 10 has a profile similar to that of the plate 4. The body 10 is associated with the plate 4 in an intermediate position between this and the box 5, by means of screws 11 crossing holes 12,13 respectively made on the same plate 4 and body 10.

For that purpose the body 10 features a center hole 14, which is crossed, in mounting position, by the grooved cylinder 3 pulled by the pulley 1. The rim of hole 14 is surrounded by a curved wall 15, designed to enclose, in mounting position, the race 7 of the pulley 1.

The body 10 features symmetrically, on opposite sides, a first and a second pair of slits **16*a*, 16*b* allowing the rope 8 to come out. More precisely, said slits 16*a*, 16*b* cross the wall 15 of the body 10 according to axes slightly diverging towards the inside of the same body, and defined by a separating element 15*a*; therefore the slits 16*a*, 16*b* tend to be linked up by a line tangent to the rope 8 guide channel 17, defined between the pulley race 7 and the wall 15 of the guide means 9**.

The slits **16*a*, 16*b* provided on each side of the control device form respective outlets for the rope 8**.

Figure 2:
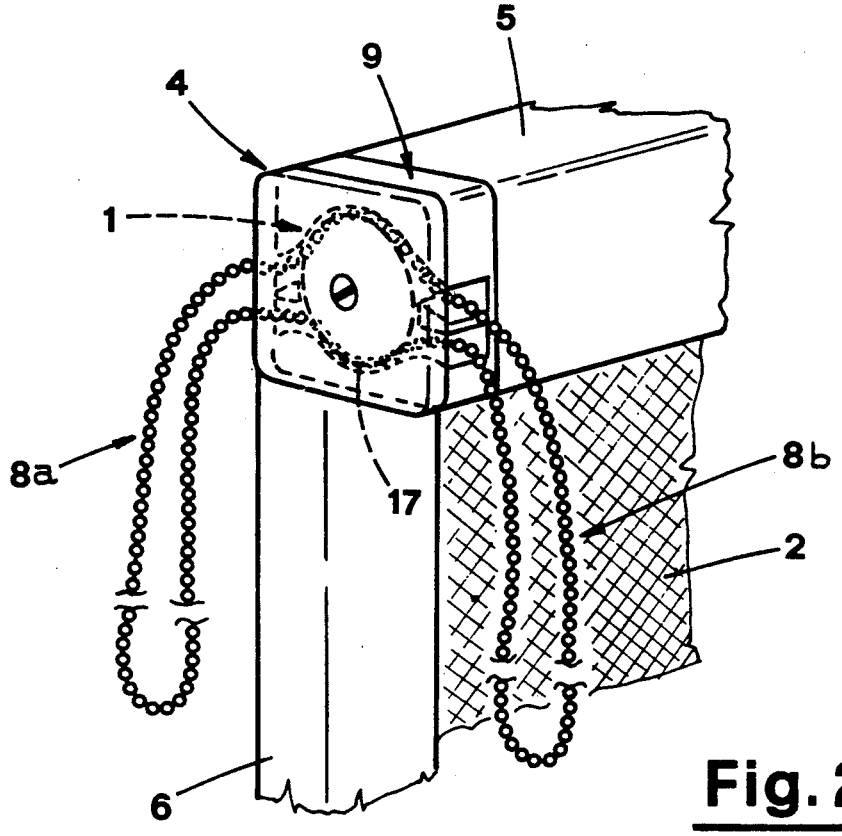
FIG. 2 is a perspective view of the device with control on both sides, i.e. from outside and from inside.

In particular, it is provided that through said slits **16*a*, 16*b* come out respective lengths of the rope, for the sake of clarity designated by 8*a* and 8*b* in FIG. 2. The lengths 8*a* and 8*b* of the rope come down from opposite sides with respect to the roll-up cloth curtain 2, so allowing it to be operated both from outside and from inside. As a matter of fact, the operation of one of such rope lengths brings about the rotation of the pulley 1**, while the other length follows the circular motion induced by the same pulley.

The engagement of the rope 8 in the seatings 7*a* of the race 7, provided by the closing of the channel 17, prevents the traction exerted on a length of rope from altering the opposite length.

Figure 3:
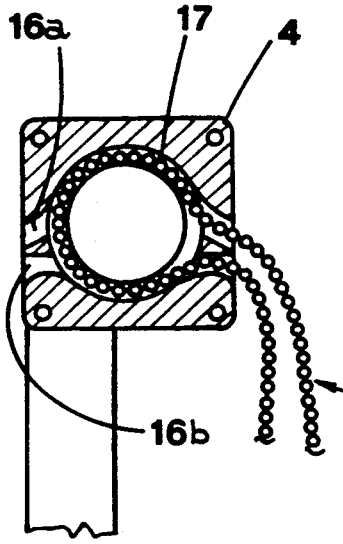
FIG. 3 is a sectional view of the device in the embodiment with control from inside.
Figure 5:
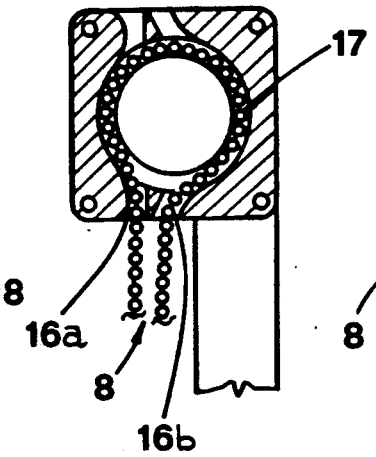
FIG. 5 is a further advantageous embodiment of the present device.
Figure 4:
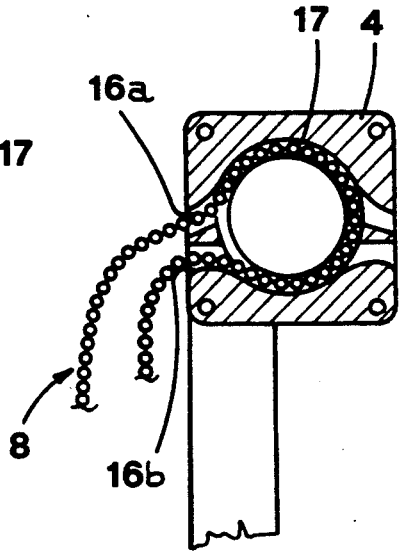
FIG. 4 is a sectional view of the device in the embodiment with control from outside.

It is also possible to have only a single rope length coming out of the device, both through the inward slits (FIG. 3) and the outward slits (FIG. 4), as well as through the downward slits (FIG. 5).

For such purpose, it is sufficient to provide for the winding of the rope onto the race 7 for the whole circular portion which leads to the outlet slits used.

Thanks to the symmetrical shape, the control device may further be mounted indifferently on the right or on the left side with respect to the winding roller.

Thus the control device being the object of this invention turns out to be of universal use, since it allows to comply conveniently with all the different requirements arising upon the installation of roll-up cloth curtains. Furthermore, it is of simple and inexpensive construction; in particular, the guide means is preferably obtained from a single piece of plastic material by molding.

It is understood that the above has been described by way of example and it is not restrictive, therefore any other possible embodiment is to be considered as covered by the patent hereby applied for, as described above and as claimed here below.

What is claimed is:

1. A device for controlling the operation of a roller for a roll-up curtain to be placed in an opening; comprising a plate for mounting the device to a surface, a rotatable pulley mounted to said plate for rotating the roller, said pulley having a race adjacent one face of the plate forming a lock slot in which an operating cord is located to rotate the pulley, and guide means attached to said plate overlying said pulley race to form a channel therebetween in which the operating cord travels, said guide means having outer walls and a pair of exit slits of each of two diametrical opposing outer walls which communicate with said channel for the cord to extend from both slits of either one or both of the pair of slits to operate the pulley from either side or both sides of the opening.

2. A device according to claim 1, wherein said guide means comprises a body having a center hole, and a grooved cylinder integral with said pulley passing through said center hole.

3. A device according to claim 2, wherein said guide means has a curved inner wall on the periphery of said hole, a rim of said wall enclosing at least a part of said pulley race.

4. A device according to claim 2, further comprising a separator member at each slit pair defining a pair of diverging openings toward the inside of said guide means.

5. A device according to claim 4, wherein said slits of a slit pair are tangent to said channel.

6. A device according to claim 2, wherein said guide means has the same overall shape as said plate, and means fastening said guide means to said plate.

* * * * *